US006338216B1

(12) United States Patent
Young

(10) Patent No.: US 6,338,216 B1
(45) Date of Patent: Jan. 15, 2002

(54) INTERLOCKING CROSSBAR EASEL

(76) Inventor: Susan L. Young, P.O. Box 699, Hebron, IN (US) 46341

( * ) Notice: Subject to any disclaimer, the term of this patent is extended or adjusted under 35 U.S.C. 154(b) by 0 days.

(21) Appl. No.: 09/464,491

(22) Filed: Dec. 15, 1999

Related U.S. Application Data

(60) Provisional application No. 60/113,125, filed on Dec. 21, 1998.

(51) Int. Cl.[7] ..... A47G 1/16; A47B 23/00; A47B 97/04

(52) U.S. Cl. ..... 40/745; 40/754; 40/755; 248/444.1; 248/452; 248/453

(58) Field of Search ..... 40/745, 754, 755, 40/539, 124, 124.4; 248/459, 453, 452, 441.1

(56) References Cited

U.S. PATENT DOCUMENTS 871,833 A * 11/1907 Taylor
1,301,797 A * 4/1919 Ziegler
1,399,507 A * 12/1921 Mills, Jr.
1,666,400 A * 4/1928 Rose
2,466,599 A * 4/1949 Larkin
2,507,620 A * 5/1950 Val Barbara
2,630,641 A * 3/1953 Hessdoerfer
2,677,469 A * 5/1954 Ebert
2,832,176 A * 4/1958 Vergeer
3,282,437 A * 11/1966 Hansen
4,105,181 A * 8/1978 Breitbard
4,512,541 A 4/1985 Lietzke
5,058,850 A 10/1991 Glick
5,388,798 A 2/1995 Glick
5,660,365 A 8/1997 Glick
5,974,707 A * 11/1999 Kowalczyk

* cited by examiner

*Primary Examiner*—Anthony Knight
*Assistant Examiner*—Vishal Patel
(74) *Attorney, Agent, or Firm*—Gary M. Hartman; Domenica N. S. Hartman

(57) ABSTRACT

An improved artist and display easel that is secured from the top by use of a crossbar that interlocks with the easel to firmly hold a standard canvas or display up to twenty-four inches in height. The easel is preferably made of a flexible material so that it can be repeatedly bent down the centerline of weakness. The centerline fold creates tension on both side panels causing outward pressure. The top crossbar holds the easel body securely in place by interlocking notches. The top crossbar also holds the top of a display or canvas securely to the easel body. There are seven different height settings that correspond to standard canvas sizes. In addition, a bottom crossbar can be interlocked to the easel body to raise the base height of a display or canvas. The use of flexible material gives the easel portability, low cost and disposability.

19 Claims, 1 Drawing Sheet

INTERLOCKING CROSSBAR EASEL

CROSS-REFERENCE TO RELATED APPLICATIONS

Provisional patent No. 60/113,125, filed Dec. 21, 1998.

BACKGROUND—

Field of Invention

This invention relates to an easel for supporting standard canvas, drawing boards and displays by means of an interlocking crossbar.

Description of Prior Art

Art students are in need of a sturdy, low cost, lightweight, disposable painting easel that they can easily carry to class.

The following criteria are not currently available in one complete easel form:

1. An easel that can be secured from the top by use of a crossbar that interlocks with the easel to firmly hold a standard canvas or display in place.
2. An easel that can securely hold a canvas or display up to twenty-four inches in height as well as the six other standard sizes.
3. An easel that can be made of low cost material such as cardboard or flexible plastic for disposability.
4. An easel that is lightweight for ease of portability to painting classes, conventions, in the field painting and the like.

The following relevant prior art patents are noticed: US patents; U.S. Pat. No. 5,388,798 Glick; U.S. Pat. No. 5,058,850 Glick; U.S. Pat. No. 5,660,365 Glick; U.S. Pat. No. 4,512,541 Lietzke.

None of the prior art patents, uncovered in the search, disclosed an easel with all of the following characteristics. An easel designed for the use of both painting canvases and displays. An easel designed to employ the use of a top crossbar to secure the easel and the object in place. An easel that employs an interlocking crossbar to secure seven standard painting canvas sizes as high as twenty-four inches.

Glick in U.S. Pat. No. 5,388,798 uses a pyramidal form easel with the bottom front side edges turned up into hook like supports. These bottom hooks are intended to be the only mechanism securing the displayed object in place. This easel does not contain a self-support that would hold the easel's side walls from moving in or out.

Glick in U.S. Pat. No. 5,058,850 uses a pyramidal form easel that employs interlocking grooves on the lower front sides of the easel. The grooves allow the easel to interlock into of a specifically designed frame. This easel can not hold a display other than the frame designed to attach to the easel.

The U.S. Pat. No. 5,660,365 Glick easel design has a main front panel with side supports on each end designed to hold the easel upright. The front panel has hooked feet that support an object only from the bottom edge. The object lies against the inclined panel. The object is not secured to the easel from the top in any manner. The side panels of the easel are not as supportive as a triangle shaped base.

U.S. Pat. No. 4,512,541 Lietzke illustrates the use of a platform base and back panel designed to hold an article of merchandise to be displayed. This easel does not have proper back support to hold a painting canvas. The easel does not have any method of securing a display to the easel.

SUMMARY OF THE INVENTION

The invention comprises the following combination of features: This easel is preferably made of a flat sheet of cardboard, flexible plastic or the like. Other material such as wood, metal or ridged plastic may be used with the use of common hinges rather than folds upon lines of weakness. The easel body is formed from an isosceles triangle shape that has a line of weakness in the center that allows the shape to be folded. The easel body stands vertically as two substantially right triangular side panels. Both sides preferably have at least eight notches in them. The notches are spaced apart at specific dimensions that correspond with seven standard canvas sizes. The second piece to the easel, referred to as the top crossbar, spans across the front opening of the easel body. The crossbar preferably has at least four notches on one edge of the two longest sides. The notches are of the same size as those on the easel body. The notches interlock the top crossbar to the easel body. Tension is created between the top edge of the canvas or display and the interlocked top crossbar. The top crossbar securely holds the canvas or display from the top and also holds the easel body in place. The front lower edges of the easel body have curved supports, referred to as legs. The legs form a base that holds the bottom of a canvas or display. The third piece to the easel is the bottom crossbar, which spans across the front opening of the easel body. The bottom crossbar is an optional piece that can be used to raise the height of a canvas. The bottom crossbar has six inward notches on one edge that interlock with the bottom notches on the easel body. The bottom edge of the display or canvas is place on the bottom crossbar and secured in place by the top crossbar.

The easel has the following characteristics while in use: Folding the easel body down the centerline of weakness creates tension on both side panels causing pressure to reopen. The top crossbar holds the easel body securely in place by interlocking with the easel body.

There are preferably at least seven height settings for the top crossbar. These settings are based on the height of the canvas or display and are of the following dimensions, 11", 12", 14", 16", 18", 20", and 24". There are four notches on the top crossbar to account for a change in the easel-opening angle due to different object heights. The two widest notches on the top crossbar are preferably for object heights from 11" to 16". The two inner notches are preferably for object heights of 18" to 24" in height.

A canvas or display rests securely on the legs and front panel edges of the easel body. The canvas or display is held at an incline, preferably between 50 and 70 degrees, against the front edges of the easel body. The weight of the object against the front panel edges rests rearwardly down the easel's adjoined side panels. Downward pressure from the object rests upon the legs of the easel body. The front of the easel body is spread open depending on the width of the object. The legs of the easel body are preferably within an inch from the lower corners of the object. Once the desired width is found, the top crossbar is placed against the top of the object, interlocking with the easel body.

The easel's "V" shaped base absorbs movement from the act of painting or drawing. Pressure is forced to the lower back point of the "V" to prevent excessive movement and retain stability of the easel and the load.

The bottom crossbar is similar to the top crossbar except that it preferably has six notches on one edge and interlocks generally with the lowest notches on the easel body. This bottom crossbar is used when an increase in the object's height is desired. The object rests on the bottom crossbar rather than the easel legs.

DESCRIPTION OF THE PREFERRED EMBODIMENT

Figure 1:
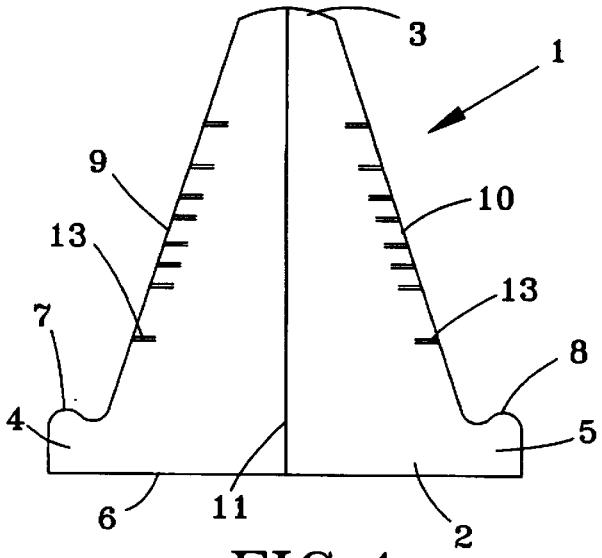
FIG. 1 is a flat plain view of the easel body.
Figure 2:
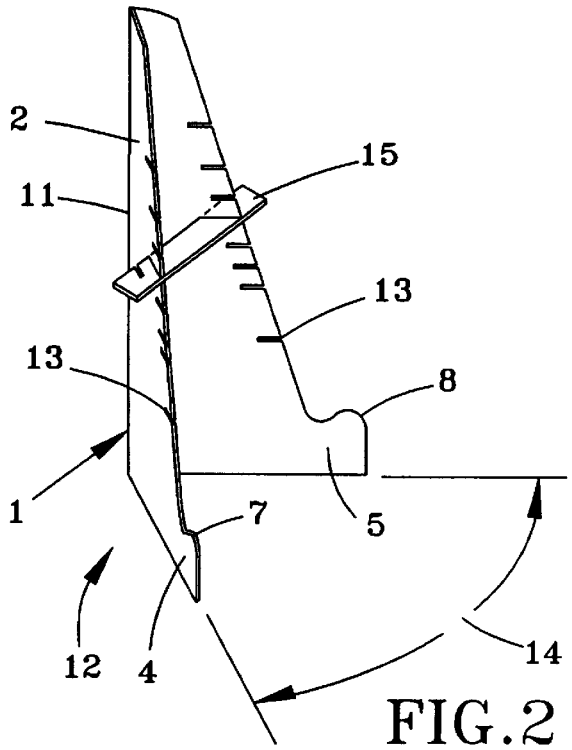
FIG. 2 is a perspective side view of the easel body, in the upright position.
Figure 5:
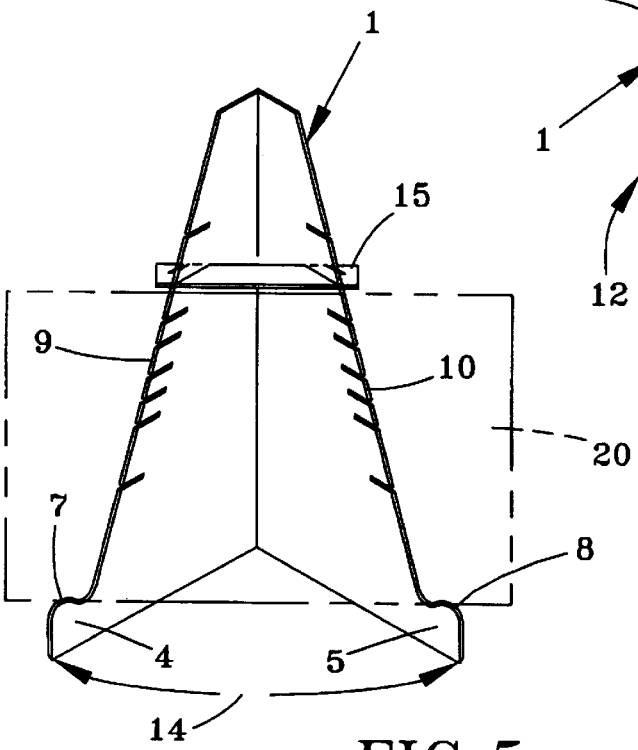
FIG. 5 is a perspective front operating view supporting a canvas or display with the top crossbar in place.
Figure 3:
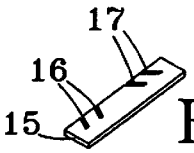
FIG. 3 is a plan view showing the top crossbar.
Figure 4:
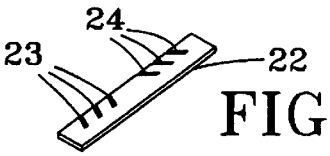
FIG. 4 is a plan view showing the bottom crossbar.

In the most basic initial state the easel body comprises of a flat, isosceles triangle shape panel 1. The panel 1 is preferably made of cardboard or flexible plastic. We prefer ¼" double walled cardboard sheet 2. The top of the panel 1 is curved around 3. The bottom edge 6 has right angle corners, left 4 and right 5, that extend up into an inward curve on each side, left 7 and right 8, forming the legs of the easel body. There are seven notches on the left 9 and on the right 10 along the side edges of the panel 1. A top crossbar 15 (FIGS. 2 and 3) interlocks with one notch on each side of panel 1 depending on the size of the display or canvas. The notches 9, 10 are the same width of the top crossbar's notches 17, 18. There are two lower notches 13 on panel 1. These notches 13 interlock with a bottom crossbar 22 (FIG. 4) when it is used. There is a line of weakness 11 along the center of panel 1. Panel 1 is folded along the line of weakness 11 allowing the easel body to stand in an upright position 12. The base of the easel body is folded to at least a one hundred-degree angle 14. The top crossbar 15 preferably 15 and bottom crossbar 22 are made of the same material as the easel body. The top crossbar 15 has four inward angled notches 16, 17 along one edge. The top crossbar connects with the easel body by interlocking the notches on the left 9 and right 10 sides. The bottom crossbar 22 of the easel body preferably has three notches on each side of one edge 23, 24. When in use, these notches interlock with the lower notches 13 on the easel body. The length of the bottom crossbar 22 is preferably longer than the top crossbar 15 and, each spans the front width of the easel when in the upright position. The legs 7, 8 hold the bottom of a canvas or display 20. The top crossbar 15 secures the top of the canvas or display to form a complete and working painting or display easel.

This foregoing disclosure relates only to the preferred embodiments of the invention; it is intended to cover all changes and modifications of multiple purpose easels described which do not constitute departures from the spirit and scope of the invention as set forth in the appended claims.

What is claimed is:

1. An easel for supporting and securing an article, the easel comprising:

a first member having first and second side portions, the first side portion having a first row of slots defined therein, the second side portion having a second row of slots defined therein;

means projecting from the first member for supporting a lower edge of the article; and means for securing an upper edge of the article, the securing means comprising a crossbar simultaneously receivable in slots of both the first and second rows of slots.

2. An easel according to claim 1, wherein the first member comprises a panel having a triangular shape.

3. An easel according to claim 2, wherein the panel comprises a fold line defining a line of symmetry thereof that separates the first and second side portions of the first member.

4. An easel according to claim 2, wherein the support means comprises legs defined at corners of the panel, the legs having notches for engaging a lower edge of the article.

5. An easel according to claim 1, further comprising backing means defined by the first and second side portions of the first member against which the article is inclined when supported on the easel.

6. An easel according to claim 5, wherein the first member comprises a panel having a triangular shape and the backing means are defined by two edges of the panel.

7. An easel according to claim 5, wherein the first and second rows of slots of the first member are disposed in the two edges of the panel.

8. An easel according to claim 1, wherein the crossbar comprises slots that are complementary to and engagable with each of the slots of the first and second rows of slots.

9. An easel according to claim 8, wherein the slots of the crossbar comprise a first row of slots at a first end of the crossbar and a second row of slots at a second end of the crossbar, the slots of the first and second rows being inclined toward each other.

10. An easel according to claim 1, further comprising a second crossbar receivable in at least a second slot of the first row of slots and at least a second slot of the second row of slots.

11. An easel according to claim 10, wherein the second crossbar comprises slots that are complementary to and engagable with the at least second slot of the first row of slots and the at least second slot of the second row of slots.

12. An easel according to claim 11, wherein the slots of the second crossbar comprise a first row of slots at a first end of the second crossbar and a second row of slots at a second end of the second crossbar, the slots of the first and second rows being inclined toward each other.

13. An easel according to claim 1, further comprising the article supported on the easel such that the upper edge of the article is secured by the crossbar.

14. An easel for supporting and securing an article, the easel comprising:

a panel having a triangular shape, a fold line defining a line of symmetry of the panel, a first corner substantially bisected by the fold line, a pair of corners separated by the fold line, a first edge between the first corner and a first of the pair of corners, and a second edge between the first corner and a second of the pair of corners;

a first row of slots defined in the first edge and a second row of slots defined in the second edge;

means defined at each of the pair of corners for supporting a lower edge of the article; and a crossbar simultaneously engaged with at least one slot of each of the first and second rows of slots, the crossbar spacing and securing the first and second edges of the panel apart from each other, the crossbar being adapted to secure an upper edge of the article.

15. An easel according to claim 14, wherein the support means comprises legs defined at the pair of corners of the panel, the legs having notches for engaging the lower edge of the article.

16. An easel according to claim 14, wherein the crossbar comprises slots that are complementary to the at least one slots of the first and second rows of slots of the panel, a first slot of the crossbar being engaged with the at least one slot of the first row of slots of the panel, and a second slot of the crossbar being engaged with the at least one slot of the second row of slots of the panel.

17. An easel according to claim 16, wherein the slots of the crossbar comprise a first row of slots at a first end of the crossbar and a second row of slots at a second end of the crossbar, the slots of the first and second rows being inclined toward each other.

18. An easel according to claim 14, further comprising a second crossbar engaged with at least a second slot of the first row of slots and with at least a second slot of the second row of slots.

19. An easel according to claim 18, wherein the second crossbar comprises slots that are complementary to the at least second slots of the first and second rows of slots of the panel, a first slot of the second crossbar being engaged with the at least second slot of the first row of slots of the panel, and a second slot of the second crossbar being engaged with the at least second slot of the second row of slots of the panel, the first and second slots of the second crossbar being inclined toward each other.

* * * * *